US008336843B2

(12) United States Patent
Gulbrandsen et al.

(10) Patent No.: US 8,336,843 B2
(45) Date of Patent: Dec. 25, 2012

(54) SECURE LOCKING ATTACHMENT DEVICE USEFUL WITH SUSPENDED CEILING SYSTEMS

(75) Inventors: Peder Gulbrandsen, Aurora, IL (US); Abraham M. Underkofler, Waukegan, IL (US); Mark R. Paulsen, Waukegan, IL (US)

(73) Assignee: USG Interiors, LLC, Chicago, IL (US)

( * ) Notice: Subject to any disclaimer, the term of this patent is extended or adjusted under 35 U.S.C. 154(b) by 631 days.

(21) Appl. No.: 12/503,886

(22) Filed: Jul. 16, 2009

(65) Prior Publication Data

US 2011/0011023 A1 Jan. 20, 2011

(51) Int. Cl.
*A47H 1/10* (2006.01)

(52) U.S. Cl. ..... 248/317; 248/339; 248/489; 24/536; 24/537

(58) Field of Classification Search ..... 52/29, 285.3, 52/489.1, 489.2, 506.05, 506.06, 506.07, 52/506.08; 248/317, 339, 489; 24/536, 537
See application file for complete search history.

(56) References Cited

U.S. PATENT DOCUMENTS

| | | | | | |
|---|---|---|---|---|---|
| 134,756 | A | * | 1/1873 | Marston | 40/664 |
| 172,555 | A | * | 1/1876 | Clark | 131/258 |
| 183,556 | A | * | 10/1876 | Fyfe | 24/537 |
| RE9,506 | E | * | 12/1880 | Ellis | 24/537 |
| 3,436,047 | A | * | 4/1969 | Foltz | 248/317 |
| 3,598,013 | A | * | 8/1971 | Broberg | 411/79 |
| 3,599,921 | A | * | 8/1971 | Cumber | 248/317 |
| 3,608,857 | A | * | 9/1971 | Hibbeler | 248/317 |
| 3,998,020 | A | * | 12/1976 | Kuhr et al. | 52/506.07 |
| 3,998,419 | A | * | 12/1976 | Semmerling | 248/323 |
| 4,040,758 | A | * | 8/1977 | Sauer | 403/397 |
| 4,905,952 | A | | 3/1990 | Pinquist | |
| 5,893,250 | A | * | 4/1999 | Benvenuto et al. | 52/506.08 |
| 7,062,886 | B2 | * | 6/2006 | Auriemma | 52/506.07 |
| 7,264,214 | B2 | * | 9/2007 | Oh | 248/342 |
| 7,478,787 | B2 | * | 1/2009 | Bankston et al. | 248/343 |

* cited by examiner

*Primary Examiner* — Jeanette E Chapman
*Assistant Examiner* — James Buckle, Jr.
(74) *Attorney, Agent, or Firm* — Peare & Gordon LLP

(57) ABSTRACT

An attachment device useful with suspended ceiling systems is provided. In disclosed embodiments, the device comprises a clip that matingly engages a bulb of a ceiling grid tee. The device may include a reinforcing sleeve and can be used to increase the load carrying capacity of suspended ceiling systems while providing a simple, quick method of attaching the suspended ceiling grid to the true ceiling.

1 Claim, 5 Drawing Sheets

SECURE LOCKING ATTACHMENT DEVICE USEFUL WITH SUSPENDED CEILING SYSTEMS

BACKGROUND OF THE INVENTION

The present invention generally relates to suspended ceiling systems and parts therefore, and more particularly to an attachment device uniquely designed to provide an improved connection between members of the ceiling grid framework and points above the suspended ceiling.

Suspended ceilings, extensively used in commercial buildings, typically employ a rectangular grid system that supports lay-in ceiling panels or tiles. The grid is made up of regularly spaced runners intersecting at right angles. The runners are ordinarily in the form of inverted tees. The tees are normally suspended by wires or other hanging mechanisms, and the ceiling panels or tiles rest on the flanges of the tees.

Typically, long tees also known as main runners are supported by wires, and they help to provide the strength necessary to suspend the ceiling grid system. These main runners are normally installed parallel to each other and spaced apart at equal intervals. Shorter cross tees are connected to these main tees to provide the grid in which ceiling panels are laid.

The suspended ceiling products industry has refined the design and manufacture of grid tees and attachment mechanisms to a degree. The continuous efforts for improvement have contributed to the high acceptance of these ceiling systems in the construction industry. Challenges have remained in creating improvements in performance and strength while reducing the costs of labor in installing the grid systems.

BRIEF SUMMARY OF THE INVENTION

The invention relates to a device that is particularly useful in suspended ceiling systems and can be used to increase the load carrying capacity of the system while providing a simple, quick method of attaching the suspended ceiling grid to the overlying superstructure. More specifically, a clip is provided that engages a ceiling grid tee. In disclosed embodiments, the clip includes a bottom portion that matingly engages the ceiling tee. The bottom portion of the clip preferably engages the lower part of the bulb of the ceiling tee and is configured to provide a simple, quick and extremely secure connection between the clip and the tee.

The clip can be made from a resilient material such as metal or synthetic polymer and is configured so that the clip is self-biasing or pre-loaded and can snap into place around the bulb of the tee. Preferably, the clip has a top portion that is adapted to receive a wire or other hanging mechanism so that the tee can be suspended from the true ceiling above what will be the suspended ceiling. If the hanging mechanism or device is a screw that attaches the tee to a floor/ceiling joist, for instance, many or all of the clips can be attached to the joists first without having to install the ceiling tees at the same time thereby saving some time in the ceiling grid installation process. Moreover, ceiling tees can be removed and replaced more easily when using the attachment device described herein, for instance if a tee is damaged or if a change to a different style of ceiling grid is desired.

In disclosed embodiments, the device includes a reinforcing sleeve configured to matingly engage the clip. The reinforcing sleeve may straddle or rest on top of the clip to provide added lateral strength to the clip/grid tee connection so that the clip is more securely attached to the tee. The reinforcing sleeve may have a slit or aperture on its top portion so that the top of the clip can pass through the top of the sleeve. Alternatively, the sleeve may have a recess or notch on its top portion that is continuous throughout one of its side walls so that the sleeve can more easily be placed over the clip after the clip is attached to the ceiling grid tee or after the clip is attached to overhead structure.

DETAILED DESCRIPTION OF THE INVENTION

Figure 1:
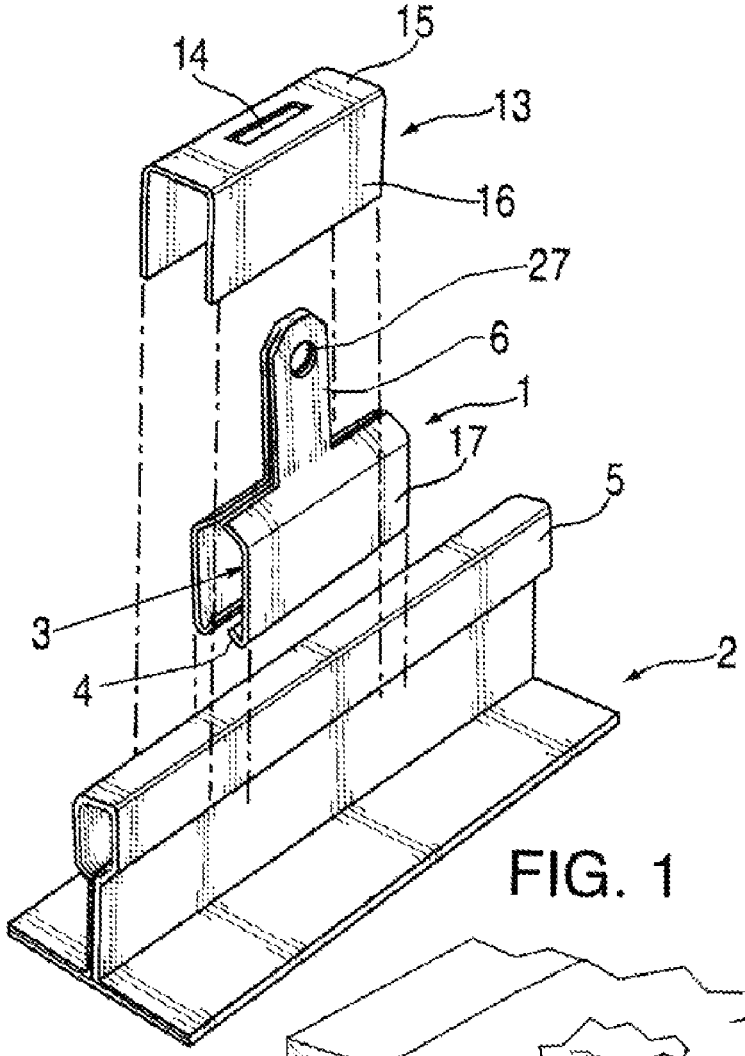
FIG. 1 is a top perspective, exploded view of an embodiment of the present device in which a reinforcing sleeve is positioned above a clip which is in turn positioned above a ceiling grid tee.
Figure 2:
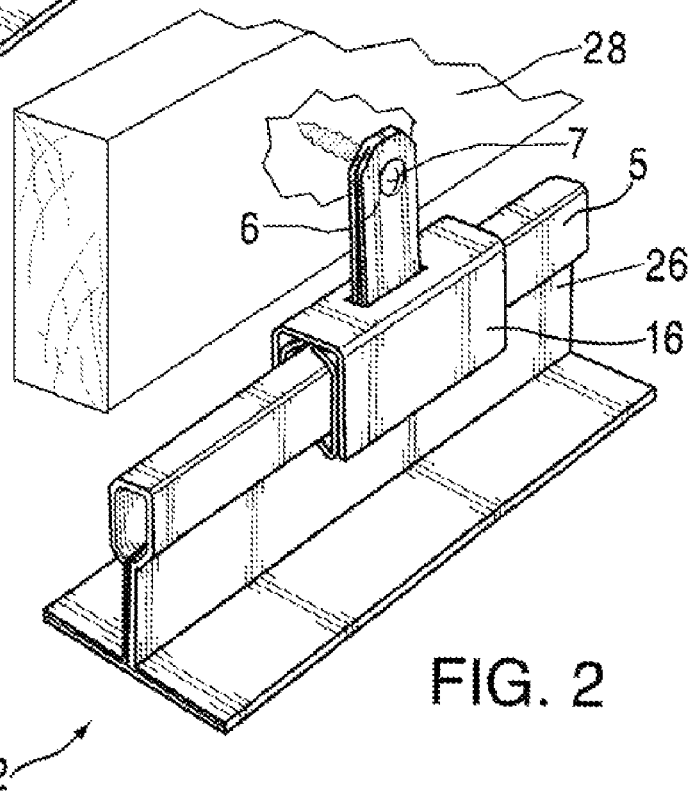
FIG. 2 is a top perspective view of the embodiment shown in FIG. 1 in which the device is assembled on the ceiling grid tee.

Referring first to FIGS. 1 and 2, a clip 1 is provided that engages or attaches to a ceiling grid tee 2. The clip 1 is preferably manufactured to be a unitary piece, but it can also be manufactured as two or more pieces that can be assembled at the job site by an installer. In an embodiment, the clip 1 can be manufactured from a single piece of metal that is formed by punching or cutting and folded in half so that it is symmetrical about a vertical mid-plane as shown in FIG. 1. The clip 1 in another embodiment can also be asymmetrical as shown, for example, in FIG. 3.

In certain embodiments, the clip 1 includes a bottom portion 3 that matingly engages the ceiling tee 2. The grid tee 2 illustrated in the various embodiments disclosed herein has a conventional reinforcing bulb 5 at its upper region. The bulb 5 is generally rectangular in cross-section, having a top, sides and bottom with a nominal width of ¼" and a height of ⅜". The bottom portion 3 of the clip 1 preferably has a protrusion 4 that engages the lower part or bottom wall of the bulb 5 of the ceiling tee 2 to provide better support of the tee 2. As shown in the drawings, the protrusion 4 can be upwardly curled with a lead face inclined upwardly and inwardly to assist in providing the engagement between the clip 1 and the bulb 5.

In some embodiments, the bottom portion 3 of the clip 1 can be symmetrical about a plane corresponding to the plane of a web 26 of the tee 2 and can be made from a resilient material such as metal or synthetic polymer so that the clip 1 is self-biasing or pre-loaded to simultaneously engage both sides of a tee. This means that a ceiling grid installer can position the clip 1 above a tee 2 at a desired location and thrust the clip 1 downward onto the tee 2. The resilient clip 1 snaps into place around the bulb 5 of the tee 2, and the clip 1 exerts a gripping force or inward pressure upon the bulb 5 from both sides of the bulb.

Figure 9:
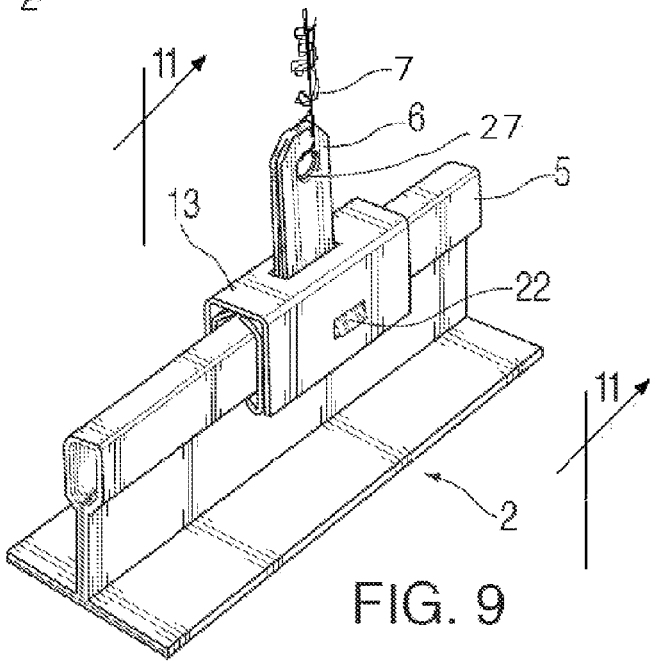
FIG. 9 is a top perspective view of the embodiment shown in FIG. 8 in which the device is assembled on the ceiling grid tee.
Figure 11:
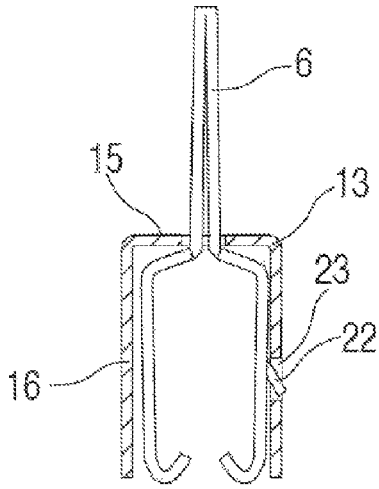
FIG. 11 is a cross section of the reinforcing sleeve attached to the clip taken along line 11-11 of FIG. 9 and in the direction generally indicated (the ceiling grid tee is not shown)

Preferably, the clip 1 has a top portion 6 with a hole 27 that is adapted to receive a wire, screw or other hanging mechanism 7 so that the tee 2 can be suspended from a structure above what will be the suspended ceiling. The structures to which the clips 1 may be attached can be, for example, c-channels or floor/ceiling joists or roof joists among other things. This top portion 6 may be of sufficient length such that when a wire 7 (FIG. 9) that is connected to the true ceiling is attached to the clip 1, the wire will not interfere with the placement of ceiling tiles within the ceiling grid framework. The length of the top portion 6 of the clip 1 is, for example, one inch (two and one half centimeters), two inches (five centimeters), three inches (seven and three quarters centimeters), six inches (fifteen centimeters) or more.

Figure 4:
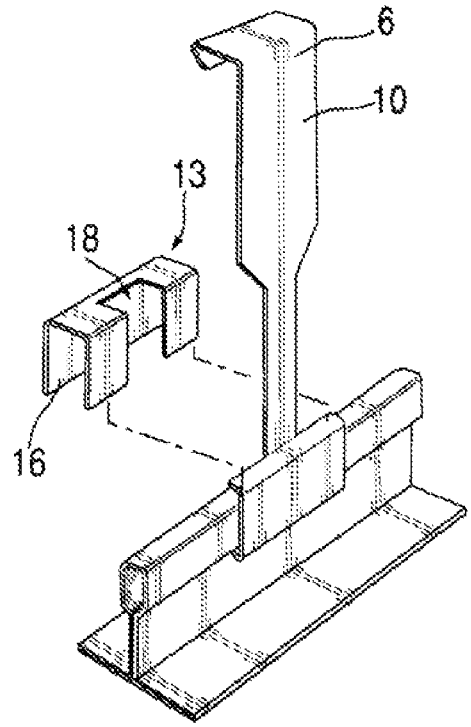
FIG. 4 is a top perspective, partially exploded view of the embodiment shown in FIG. 3 in which the reinforcing sleeve is positioned slightly above and to the left of the clip which is in turn positioned on the ceiling grid tee.
Figure 5:
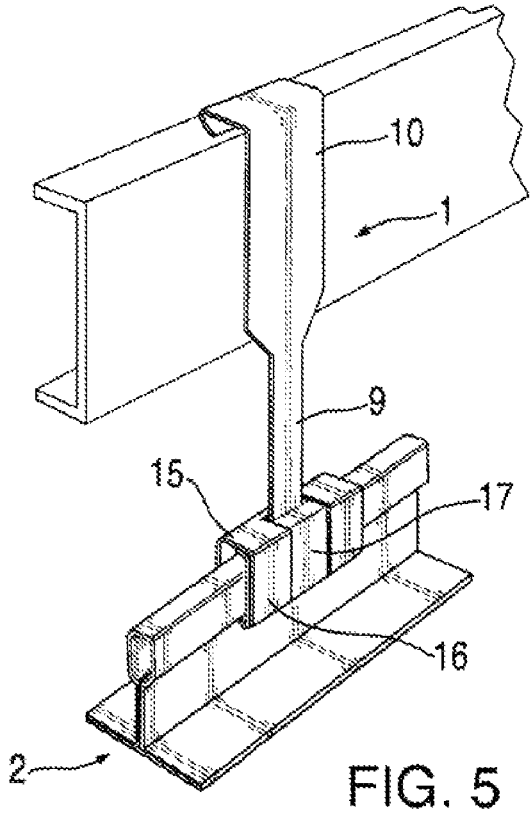
FIG. 5 is a top perspective view of the embodiment shown in FIG. 3 in which the device is fully assembled on the ceiling grid tee.
Figure 6:
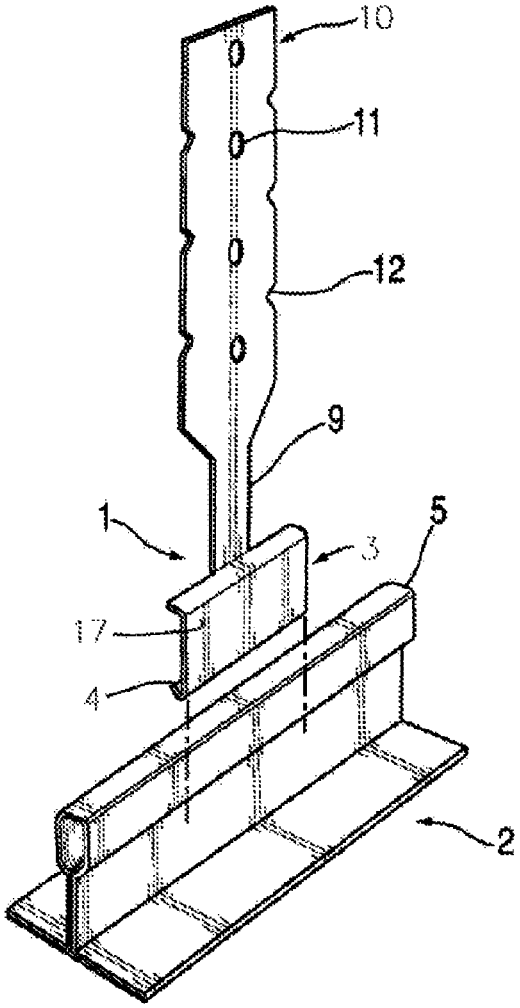
FIG. 6 is a top perspective, exploded view of an embodiment of a clip of the present device that is positioned above a ceiling grid tee (a reinforcing sleeve is not shown)
Figure 7:
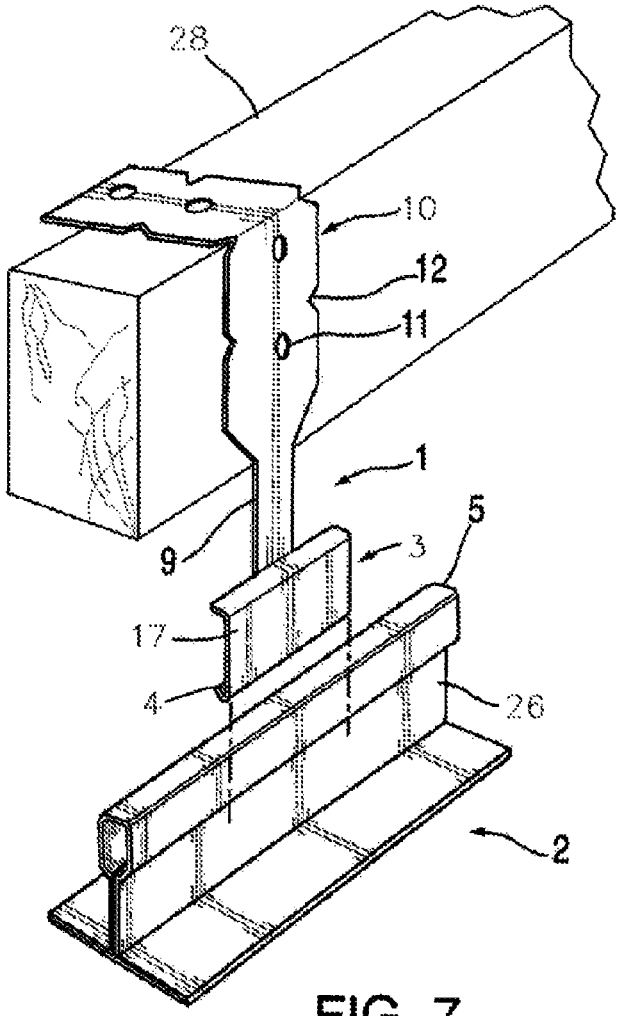
FIG. 7 is a top perspective, exploded view of the clip of FIG. 6 that is shown with a bend made in the field by an installer and positioned above a ceiling grid tee (a sleeve is not shown)
Figure 8:
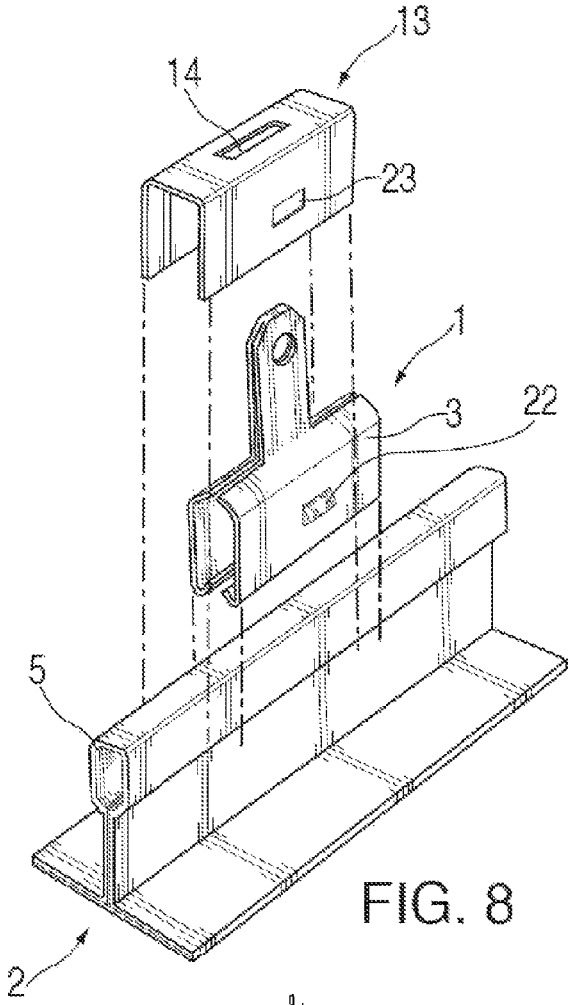
FIG. 8 is a top perspective, exploded view of an embodiment of the present device in which a reinforcing sleeve with a through slot is positioned above a clip with a locking tab which is in turn positioned above a ceiling grid tee.
Figure 10:
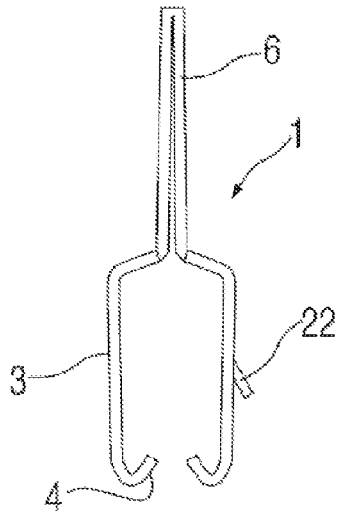
FIG. 10 is an end view of the clip shown in FIG. 8.
Figure 12:
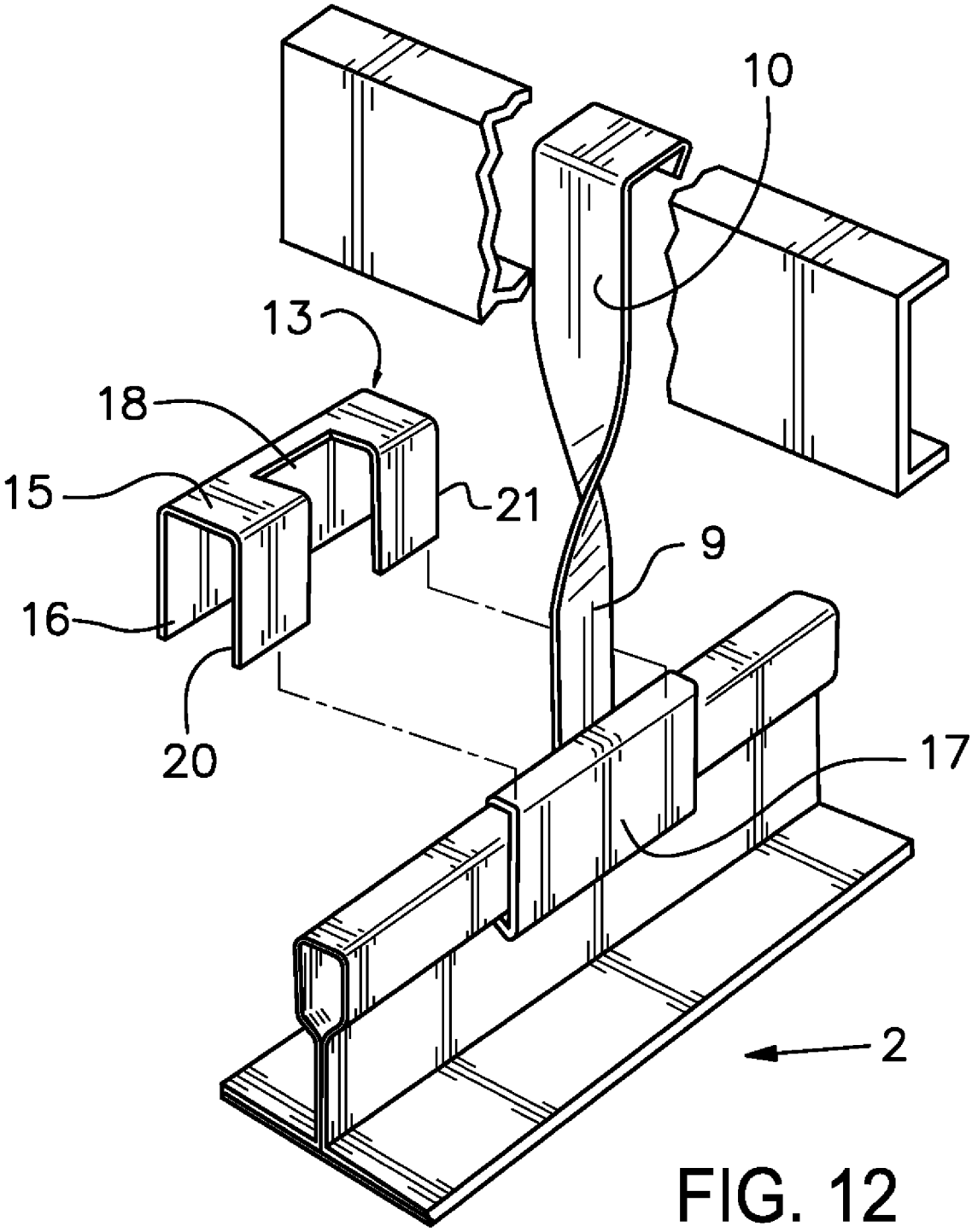
FIG. 12 is a top perspective view of still another embodiment of the device assembled on a ceiling grid tee.

In certain embodiments as depicted in FIGS. 3 through 7, and 12, the top portion 6 of the clip 1 may have an elongated neck 9 and an attachment head 10 optionally with one or more screw holes 11. As shown in FIGS. 6 and 7, notches 12 may be placed along the sides of the head 10 or neck 9. The notches 12 can act as guide marks to more easily align the clip 1 perpendicular to floor/ceiling joists. Moreover, if the clip 1 is made of metal, the notches 12 can facilitate bending of the clip 1 so that part of the head 10 or neck 9 rests upon a structure 28 (FIG. 7) above the suspended ceiling. The head 10 can also be fastened to the structure with a screw or other fastening means to provide a more secure connection. As shown in FIG. 12, the clip 1 may be manufactured to have a twist along the neck 9 and/or head 10 so that the plane of a major part 29 of the attachment head 10 is perpendicular to the plane of the side wall 17 of the bottom portion 3 of the clip 1.

The clips 1 of the embodiments of FIGS. 3-7 and 12 are asymmetrical in that the lower part or bottom portion 3 is generally C-shaped and has only one side wall 17. The side wall 18 abuts one side of a tee bulb 5 with its protrusion 4 underlying the lower wall or face of the bulb The clip 1 is locked in this position by the reinforcing sleeve 13 having its side walls 16 spaced so that one abuts the clip side wall 17 and one abuts the side of the bulb 5 remote from the clip side wall thereby locking the clip protrusion 4 under the bulb. The clip 1 is preferably proportioned so that when it is installed on a grid tee 2 the neck 9 lies in the mid-plane of the tee, i.e. in the plane of the web.

In certain embodiments, the device includes a reinforcing sleeve 13 which can be configured to matingly engage the clip 1. It is believed that one benefit of using a sleeve 13 in the attachment device is that thinner gauges of materials can be used to manufacture the clip 1 because the sleeve 13 provides the additional strength necessary that a clip 1 made from a thicker gauge of material would otherwise provide. In addition, alternative compositions of materials that otherwise have insufficient strength or resilience can be used to manufacture the attachment device in embodiments that incorporate the reinforcing sleeve 13.

Preferably, the reinforcing sleeve 13 has a slit or aperture 14 on its upper or top portion 15 so that the top 6 of certain embodiments of the clip 1 can pass through the top of the sleeve. The reinforcing sleeve 13 can rest generally on top of the clip 1 and provide added lateral strength so that the clip 1 remains engaged with the tee 2 to which it is attached. The sleeve 13 can have an inverted U-shape and can be made from a resilient material. It can also be self-biasing or pre-loaded with an interference fit to ensure that there is engagement and inwardly directed lateral force applied by the sides 16 of the sleeve 13 as it straddles the clip 1. Alternatively, the sleeve 13 can be made to be relatively rigid so that it is simply slid over the clip 1 to provide reinforcement without a pre-loaded inwardly directed lateral force.

The vertical height of the side portions or side walls 16 of the sleeve 13 are preferably the same vertical height as corresponding side portions 17 of the clip 1. Moreover, the horizontal lengths of the side walls 16 of the sleeve 13 are preferably approximately the same horizontal lengths as corresponding side walls 17 of the clip 1. However, the dimensions of the sleeve's side walls 16 could be less than the dimensions of the corresponding side walls 17 of the clip 1 if it were desirable to reduce the amount of raw materials used in making the sleeve 13. For instance, the horizontal length of the sleeve side portions 16 may be one half that of the corresponding clip side portions 17. Alternatively, the dimensions of the sleeve side portions 16 may be greater than the corresponding clip side portions 17. In addition, the sleeve 13 can have lower protrusions or lip portions similar to the protrusions 4 of the clip 1 configured in a manner that would allow the sleeve 13 to snap into place on top of the clip 1, similar to the action of the clip 1 when placed on the bulb 5 of the tee 2.

Figure 3:
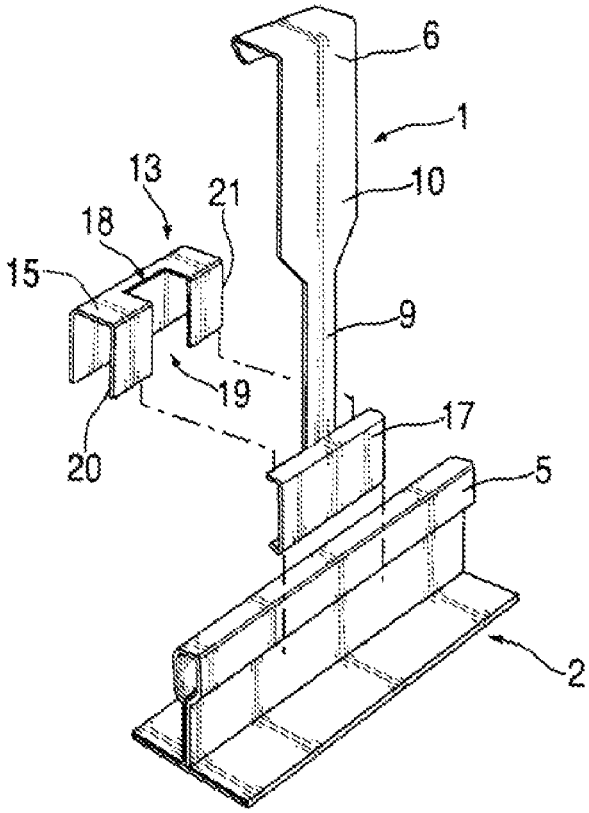
FIG. 3 is a top perspective, exploded view of an alternative embodiment of the present device in which a reinforcing sleeve is positioned slightly above and to the left of a clip which is in turn positioned above a ceiling grid tee.

As shown in FIGS. 3 through 5, the sleeve 13 may have an opening, notch or recess 18 along its top wall 15 that is continuous with one of its side walls 16. The recess 18 may have a polygonal shape that accommodates the upper or top portion 6 of the clip 1. In other words, the top wall 15 may define a polygonal recess 18 that also defines an opening 19 in one of the side walls 16. As a result, the side wall 16 has two portions 20, 21 that are spaced from each other in the longitudinal direction of the grid tee. In one embodiment, the longitudinal spacing of the two side wall portions 20, 21 approximates the size of the notch 18 of the top wall 6. This open sided sleeve makes it simpler for an installer to first mount the clip 1 to a surface or structure above what will be the suspended ceiling, then attach the clip 1 to the bulb 5 of the ceiling tee 2, and then place the reinforcing sleeve 13 over the bottom portion 3 of the clip 1 to lock it into place.

It can be appreciated that different versions of the clip 1 can be used with different versions of the sleeve 13 to provide an attachment device that has varying degrees of strength or load carrying capacity. The clips 1 and sleeves 13 can also be manufactured to have locking engagement with each other. For instance, as shown in FIGS. 8 through 11, the clip 1 could have a locking tab 22 on one or both side walls 17. In FIGS. 8 through 11, the tab 22 is shown with an opening in a downward direction, but the tab 22 could open in other directions. The locking tabs 22 can mate with corresponding thru slots 23 in the reinforcing sleeves 13. If there are locking tabs 22 on both sides of the clip 1 and corresponding thru slots 23 on both sides of the sleeve 13, then an extremely secure connection can be established. However, it can be appreciated that even one locking tab 22 thru slot 23 combination in each device can provide a secure connection between the clip 1 and the sleeve 13.

It is noted that use of embodiments of the clip 1 that are symmetrical (with the plane of the web 26) and pre-loaded and that engage both sides of the bulb 5 of the tee 2 as shown in FIG. 2 have been demonstrated in simple pull tests to result in a greater load carrying capacity when compared to embodiments that engage only one side of the bulb 5 of the tee 2 as shown in FIG. 5. While not limiting to any particular theory, it is believed that the surprisingly greater load carrying capacity of the two-sided clip is due to a combination of (a) the increased frictional force that results from the clip 1 engaging two sides of the bulb 5 and (b) the added support that results when two sets of protrusions 4 engage the lower portions or underside of the bulb 5.

For example, simple pull tests as known in the art were conducted on the clips 1 using a tension testing apparatus. Tension in a wire connected to the clip 1 of an attachment device pulling away from a tee 2 was gradually increased until the attachment device broke free from the tee 2. The tension (in pounds) at which the attachment device broke free was recorded.

Three tests were conducted using an attachment device comprising a two-sided clip 1 and sleeve 13 as depicted in FIG. 2, and three tests were conducted using an attachment device comprising a one-sided clip 1 and sleeve 13 as depicted in FIG. 5. In all tests, a six inch section of DONN® DX® /DXL 24 branded ceiling grid main tee was used. The clips 1 were each made from 0.037 in. (20 gauge) galvanized steel, and the sleeves 13 were made from 0.047 in. (18 gauge) galvanized steel. The tension producing apparatus 24 used was a Dillon TC2 Tension/Compression Tester with a five hundred pound load cell.

In the case of the two-sided clip 1, the clip 1 never broke free of the tee 2 during testing. It is noted that the maximum tension that was recorded on all three tests was four hundred ninety pounds of tension because of the limitations of the tension tester, which had a maximum of five hundred pounds tension that could be created. The actual tension that the two-sided clip 1 could sustain may very well be much higher than four hundred ninety pounds. The average tension that could be sustained by the one-sided clip 1 was two hundred ninety seven pounds. Detailed results of the testing are listed in the below Table 1.

TABLE 1

| TWO-SIDED CLIP Tension Test Results | ONE-SIDED CLIP Tension Test Results |
|---|---|
| First Test - More than 490 lbs. of tension | First Test - 301 lbs. of tension |
| Second Test - More than 490 lbs. of tension | Second Test - 284 lbs. of tension |
| Third Test - More than 490 lbs. of tension | Third Test - 306 lbs. of tension |

While particular embodiments of the present device have been shown and described, it will be appreciated by those skilled in the art that changes and modifications may be made thereto without departing from the invention in its broader aspects and as set forth in the following claims.

What is claimed is:

1. An attachment device useful in suspended ceiling grid systems, the attachment device comprising:

a clip configured to matingly engage a ceiling tee; and a reinforcing sleeve configured to matingly engage the clip to provide a secure connection to the tee, the clip being formed by resilient sheet metal and being symmetrical about a central vertical plane, the clip having a top portion adapted to be suspended from an overlying structure and a bottom portion for engaging a bulb of the tee, the bottom portion being formed by a pair of spaced side portions, lower edges of the side portions forming inturned protrusions, a lead face of each protrusion being inclined upwardly and inwardly whereby the clip can be snapped over a bulb by thrusting the clip downward onto the tee such that the side portions are laterally adjacent the bulb and the protrusions underlie the bulb, the protrusions in a free state of the clip in assembled condition on the bulb being proportioned to substantially underlie the bulb, the reinforcing sleeve having an inverted U-shape and a central slot for receiving the top portion of the clip, the sleeve being proportioned to slip over the bottom portion of the clip and increase retention of the clip on the bulb, one of said side portions of the clip including a locking tab that lies alongside the bulb when the clip is installed on the tee and the reinforcing sleeve has a vertical side with a slot for receiving the locking tab.

* * * * *